United States Patent [19]

Eriksson et al.

[11] Patent Number: 4,628,899

[45] Date of Patent: Dec. 16, 1986

[54] HEATING APPARATUS AND METHOD AND DEVICE FOR PRODUCING THE HEATING APPARATUS

[75] Inventors: Lennart Eriksson; Åke Polteg, both of Kalmar, Sweden

[73] Assignee: Cronspisen AB, Emmaboda, Sweden

[21] Appl. No.: 624,679

[22] PCT Filed: Oct. 20, 1982

[86] PCT No.: PCT/SE82/00338

§ 371 Date: Jun. 18, 1984

§ 102(e) Date: Jun. 18, 1984

[87] PCT Pub. No.: WO84/01614

PCT Pub. Date: Apr. 26, 1984

[51] Int. Cl.[4] ..... F24C 15/08

[52] U.S. Cl. ..... 126/64

[58] Field of Search ..... 126/114, 119, 8, 64, 126/79, 400, 280; 110/322, 323, 325, 336, 338

[56] References Cited

U.S. PATENT DOCUMENTS

| | | | |
|---|---|---|---|
| 187,999 | 3/1887 | Brunnert | 126/64 |
| 407,003 | 7/1889 | Elterich | 126/64 |
| 467,759 | 1/1892 | Sipos | 126/64 |
| 499,892 | 6/1893 | Schmidt | 126/64 |
| 4,461,272 | 7/1984 | Larsson et al. | 126/64 |

FOREIGN PATENT DOCUMENTS

| | | | |
|---|---|---|---|
| 56421 | 11/1912 | Austria | 126/64 |
| 9755 | 8/1879 | Fed. Rep. of Germany | 126/64 |
| 13058 | of 1900 | Fed. Rep. of Germany | 126/64 |
| 319855 | 3/1902 | France | 126/64 |
| 2522784 | 9/1983 | France | 126/123 |
| 152912 | 10/1920 | United Kingdom | 126/64 |

*Primary Examiner*—Randall L. Green

*Attorney, Agent, or Firm*—Leydig, Voit & Mayer

[57] ABSTRACT

For a heating apparatus of the tiled stove-type having a return chamber section, a stove section providing a hearth, and a foot section, blocks for erecting the sections of the heating apparatus include blocks for the stove section having cut-out portions to provide a vertical central up flue gas passage extending from the hearth, two vertical down flue gas passages situated outside the central passage and two further vertical up flue gas passages also situated outside the central passage, blocks for the return chamber section having cut-out portions providing a return chamber connecting the upper ends of the central up flue gas passage and the two down flue gas passages for returning flue gasses to the stove section, the two down flue gas passages and the two further up flue gas passages being interconnected at their lower ends, and blocks providing flue gas passages for leading flue gasses out to a chimney stack.

5 Claims, 16 Drawing Figures

HEATING APPARATUS AND METHOD AND DEVICE FOR PRODUCING THE HEATING APPARATUS

TECHNICAL FIELD

The present invention relates to a heating apparatus of the tiled stove type comprising a return chamber section, a stove section and a foot section.

In particular, the invention relates to a heating apparatus having these sections made by a plurality of individual blocks.

BACKGROUND ART

In the past, various heating apparatus of the tiled stove type were constructed by putting together different sections for burning or heat dissipation. Building such apparatus required expert knowledge and extensive labor due to the complexity and manpower involvement. Further, the finished apparatus was susceptible to cracking and leaking and a large number of building blocks are necessary for different sections of the apparatus.

DISCLOSURE OF INVENTION

It is, therefore, an object of this invention to eliminate the above-described deficiencies and to provide a heating apparatus which can be built safely and rapidly without extensive expert knowledge.

It is another object of the invention to increase operational reliability for the heating apparatus and substantially reduce the manpower requirement.

It is a further object of the invention to provide heating apparatus which requires a small number of different building block configurations which are individually of small size so that they may be more easily handled.

BRIEF DESCRIPTION OF THE DRAWINGS

Embodiments of the invention selected as examples will now be described in detail with reference to the appended drawings, on which.

BEST MODE FOR CARRYING OUT THE INVENTION

Figure 1:
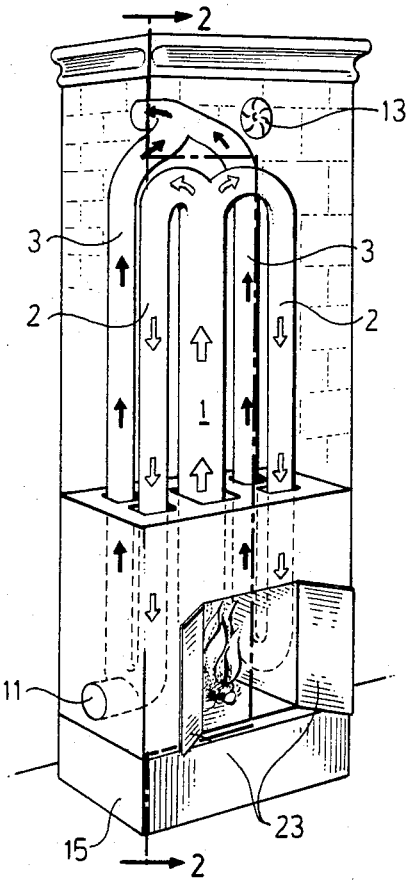
FIG. 1 generally illustrates the principal construction of a heating apparatus of the tiled stove type.

The principal construction of a heating apparatus of the tiled stove type is illustrated in FIG. 1 which is a perspective view of a tiled stove embodying the apparatus of the present invention. As can be seen, the central path of the flue gases and down and up interconnected passages are denoted by 1, 2, 3, respectively. The arrows indicate the direction of the heating air inside the stove. Numerals 11 and 13 respectively denote soot holes in the stove section and the return chamber section.

The tiled stove is divided into a foot section 15, a stove section 17 and a return chamber section 19. Each section is formed by putting individual building blocks together into horizontal courses and erecting the courses from the floor to the ceiling. A pair of doors 23 provide access to the heating apparatus from the outside. It should be noted that the apparatus in accordance with the invention is formed such that it can be erected within different ceiling heights and can be clad with tile (both ordinary flat tile and tiled stove tile) or, alternatively, be plastered or painted, or solely painted, or, alternatively provided with a scored surface without further surface treatment.

Figure 2:
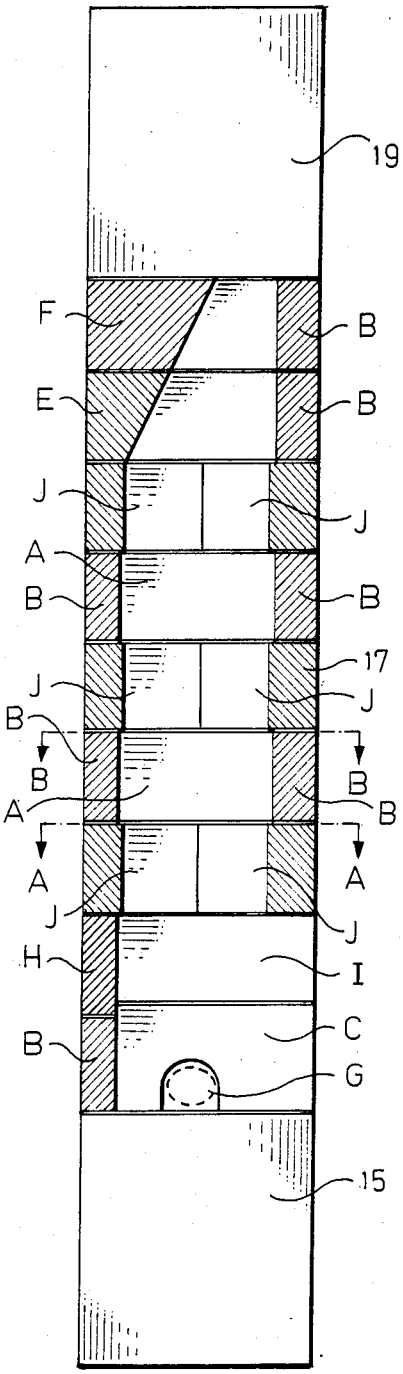
FIG. 2 is a longitudinal section through the plane 2—2 of FIG. 1, seen in the direction of the arrows.

FIG. 2 is a longitudinal sectional view taken along line 2—2 in FIG. 1. In this figure, the blocks C arranged nearest above the foot section 15 includes a hole G to accommodate the soot hole 11, which can either be placed outward towards the living room, or inward towards the fire hearth (alternatively simultaneously both outward and inward). The soot hole towards the living room is made conventionally with a stub. The rear end portions of blocks C have recesses forming dovetails for receiving blocks B with bevelled sides. Blocks I are placed on top of blocks C for reinforcing the stove section 17. Blocks I are also formed with dovetails at the rear end portions of blocking blocks H, also with bevelled sides.

The thickness of blocks I can be adjusted so that a modular pitch of 150 mm is obtained for adjusting the stove height to varying ceiling heights and varying selections of foot heights. However, the block C is thicker than block I for increasing support strength of the apparatus. As can be seen, the horizontal course immediately above the foot section, herein defined as the hearth-defining course, includes two like opposing blocks C having recesses at their rear end portions forming dovetails in which a third block B with bevelled sides is accommodated for locking and sealing the blocks and defining a hearth. The two hearth-defining opposing blocks C have greater vertical height than the third block B and cut-out portions to form up and down interconnected flue gas passages. The horizontal course immediately above the hearth-defining course includes two blocks H and I with the joining plane parallel to the plane through the soot hole G. The blocks A are made with recesses at both ends which form dovetails with opposing blocks for locking and sealing the front and rear blocks B as seen in FIG. 4.

In at least a part of the stove section 17, alternate courses (horizontal block arrangement) consist of two blocks J with cut-out portions for forming the flue gas passages 1, 2, 3 and blocks A. These blocks J are joined together along a vertical plane 21, shown in FIG. 3, and blocks A are joined by a pair of blocks B shown in FIG. 4.

Figure 3:
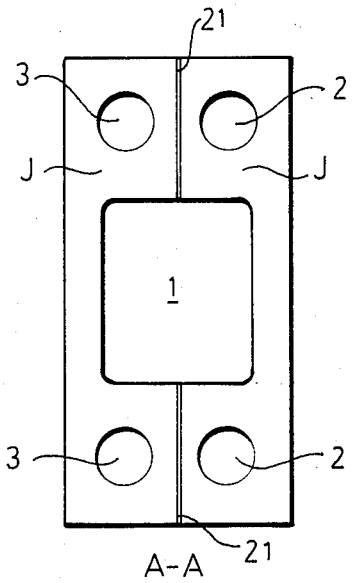
FIG. 3 is a section through the plane A—A in FIG. 2, seen in the direction of the arrows.
Figure 4:
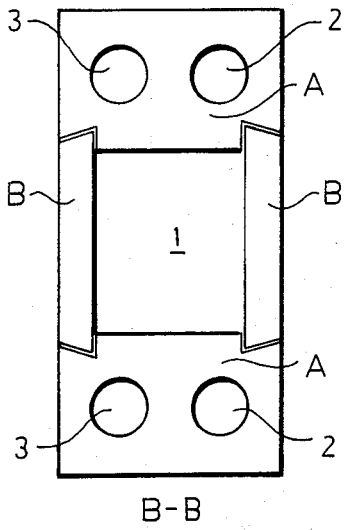
FIG. 4 is a section through the plane B—B in FIG. 2, seen in the direction of the arrows.

To avoid leakage in movements in the joints between the blocks, the vertical joints have been carried out at different directions, i.e., vertically, as in FIG. 3, and horizontally with dovetails according to FIG. 4. If, in addition, the blocks are made in varying vertical thickness for different courses, there is obtained a further strengthening and sealing structure built up in so-called bonds, each couse has the vertical joints staggered so that a joint, several courses high, is avoided in the part of the structure most subjected to high temperature.

The blocks E, F in FIG. 2 are formed at the rear edge as block B and successively thickened from course to course in an upward direction for deflecting the central flue gas path towards the front part of the return chamber section 19.

The edges occurring at the block courses provide a certain vortex formation and surface magnification which increases the desired heat absorption in heat-accumulating material.

The blocks H are of heat insulating and heat resistant material and are intended to increase the combustion temperature and also to constitute cooling against the bottom and against the rear hearth wall opposite the fire, where the temperature is otherwise high. As we have found in tests that the flue gas temperature varies between 70–100 degrees C., the insulation of the rear wall and bottom should not constitute any direct worsening of the accumulation.

As can be see, the blocks A, B, C, D, E, F, G, H, I, and J are formed such that they are reversible as far as possible, whereby a smaller number of variants is required, which also facilitates easy handling and helps ensure correct building. The lowest blocks in the stove section are formed so that they constitute a return block (provide communication between the two adjacent parallel flue gas passages), and also allow placing a soot hole on the inside or outside, or also on both inside and outside simultaneously if so desired.

The uppermost blocks in the return chamber section 19 are formed such that they allow a chimney pipe to be connected backwards, upwards, or at either side, and dimensioned such that it withstands the load from the chimney when connection is made from above. Furthermore, one of the blocks in the return chamber section 19 is formed with recesses for damper mechanism, which consideraly simplifies the installation and guarantees reliable function of the mechanism.

In general, these reversible blocks are formed so that surface finish and cladding can be carried out in any of the following ways: lime-washing, plastering, painting, surface directly of the stove material, direct fixing of flat tiles, fixing of conventional tiled stove tiles.

Figure 5:
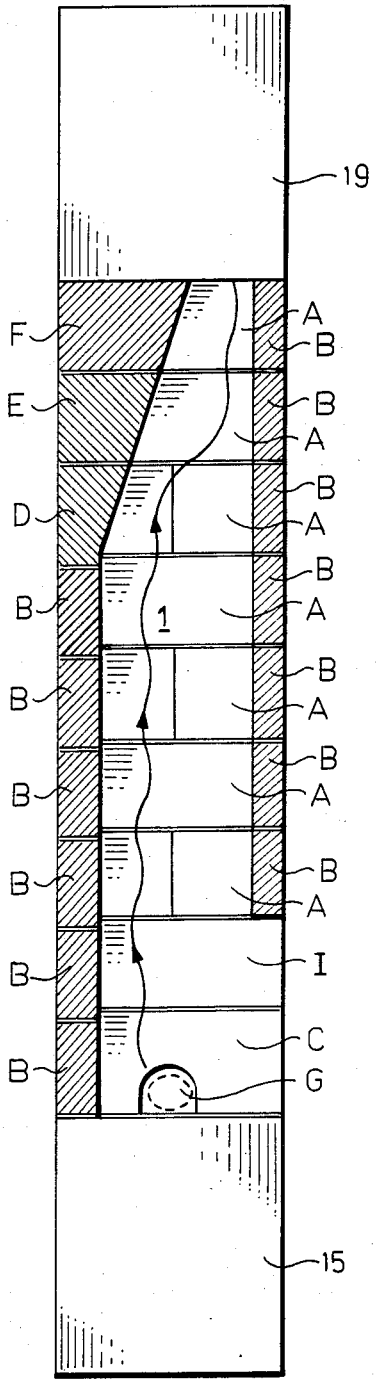
FIG. 5 is a side view of a second embodiment of the stove section in the apparatus according to the invention.
Figure 6:
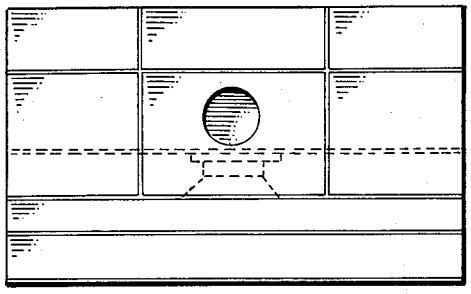
FIG. 6 is a view from the front of the return chamber section.
Figure 7:
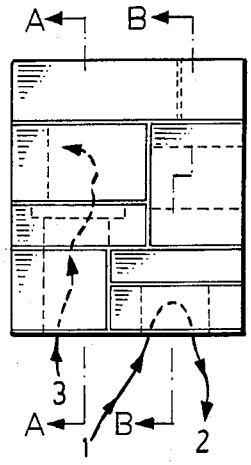
FIG. 7 is a side view in section of the return chamber section of the heating apparatus according to the invention.
Figure 8:
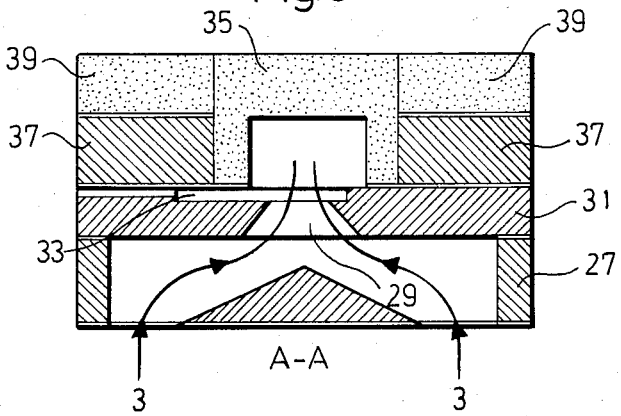
FIG. 8 is a section through the plane A—A in FIG. 7, seen in the direction of the arrows.

In the embodiment illustrated in FIG. 5 the stove section is mainly built up from A- and B-type blocks alone, according to FIG. 4. At their back edges the blocks D,E,F are formed as block B and successively thickened so that guidance of the flue gases is obtained towards the front part of the return chamber 19. Since block D in this embodiment compensates for the staggering in height, no special spinal block suited to side block C is required.

The flue gases through passage 1 from the stove section 17 go into block 25 in the return chamber section 19 which is formed as a frame and are guided out in the outer edge and down into the passage 2 on the stove section 17. After the flue gases have travelled downwards and have turned at a level with the hearth plane, they go up again through passage 3 and come into block 27 and are guided further up through a hole 29 in block 31 and up through the damper 33, placed in a recess in block 31 and into block 35 and thereafter out through the chimney stack. The chimney connection is not illustrated on the drawing. The chimney can be connected from the rear, from above or from one side, an aperture being made for a chimney muff at the place in question in block 35, which can consist of easily workable Leca with fire-resistant binder. Alternatively the block is made from two of the most usual variants with holes upwardly and at one side, respectively. A block with one hole, but which is reversable instead, may also be used. For connection at the side, one of the blocks 37 is taken out, these blocks only serving as filling bodies. The blocks 35, 39 and 41 are made with insulating aggregate (e.g. Leca) to obtain heat insulation towards the ceiling.

The foot section is made from Leca blocks to reduce the total weight, taking into account that lower carrying capacity for the substructure can then be accepted.

Figure 9:
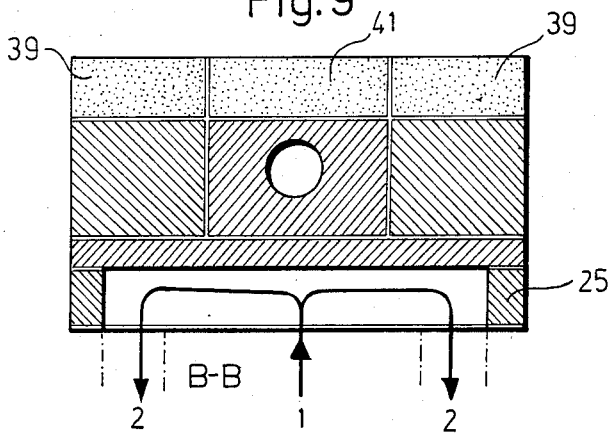
FIG. 9 is a section along the line B—B in FIG. 7, seen in the direction of the arrows.
Figure 10:
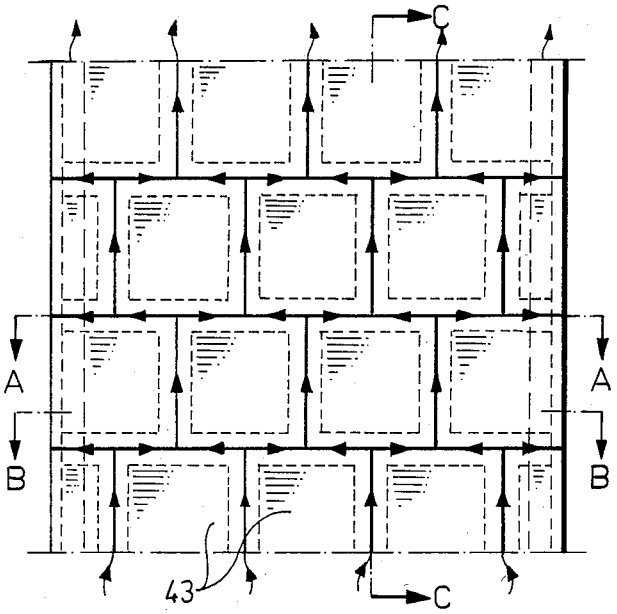
FIG. 10 is a schematic depiction seen from the front of the heating apparatus according to the invention illustrating the air duct system obtained in cladding with tiled stove tiles.
Figure 11:
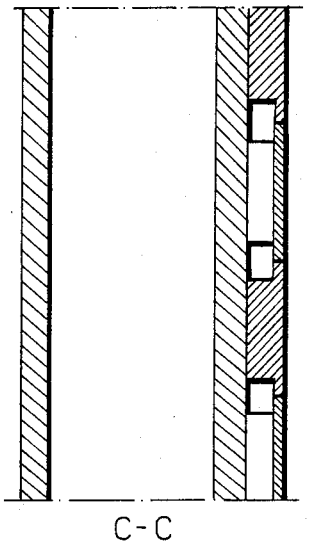
FIG. 11 is a section through the plane C—C in FIG. 10, seen in the direction of the arrows.
Figure 12:
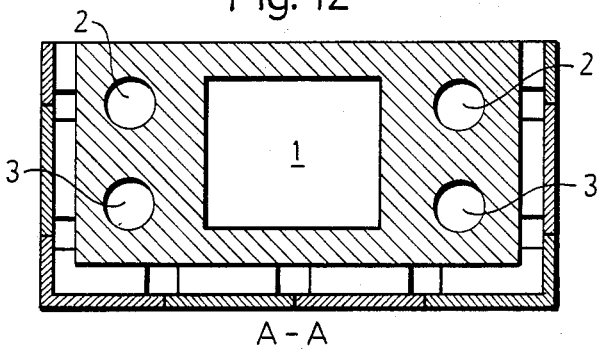
FIG. 12 is a section through the plane A—A in FIG. 10, seen in the direction of the arrows.
Figure 14:
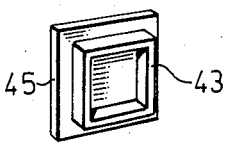
FIGS. 14 and 15 illustrate tiled stove tile in two different views.
Figure 13:
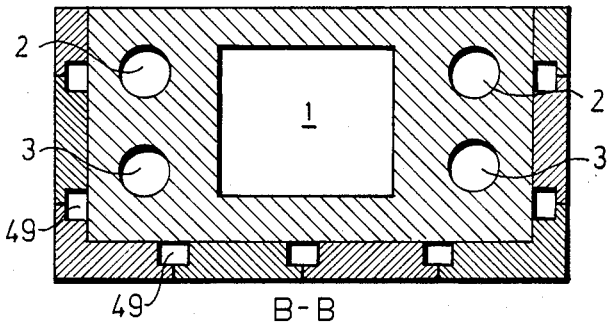
FIG. 13 is a section through the plane B—B in FIG. 10, seen in the direction of the arrows.
Figure 15:
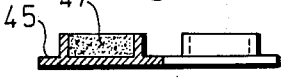

In the alterntive of cladding the block arrangement with conventional tiled stove tiles, the tile 43 can be fixed with only the middle portion of it filled out. Its flanges 45 could be free against the blocks and fixed to the core solely by the portion 47 filled out in the tile 43. There is thus obtained a channel system 49 according to FIG. 10, into which room air can easily be led, preferably at the base of the stove. Air thus flowing through the channels is heated effectively in this way by the wandering and large-surface contact with the heated tile and block arrangement. The portion 47, see FIG. 9, is filled out with brick or clay.

Figure 16:
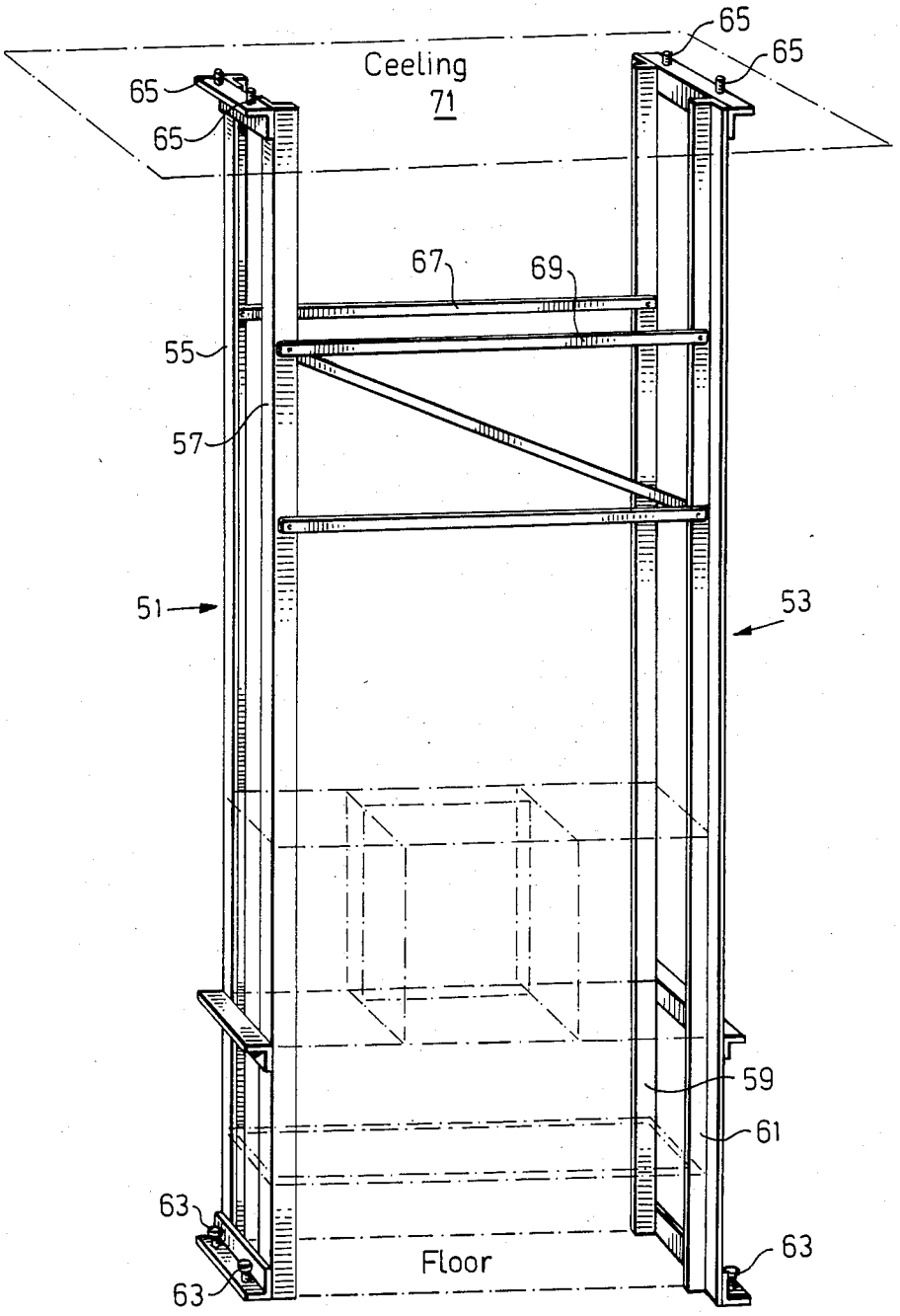
FIG. 16 shows an implementation of the erection device in accordance with the invention.

An embodiment of a fixture selected as an example for erection according to the method of the present invention is described in the following in conjunction with FIG. 16.

The erection fixture comprises two frames 51 and 53, where the uprights 55, 57 of the frame 51 go round two corners in the block tiled oven, and two vertical uprights 59, 61 of the frame 53 constitute defining lines for the extension of the block tiled oven laterally. At the bottom edge of the respective frame there are adjusting screws 63, which are to be used partly for adjustment during plumbing and partly for mutual level adjustment between the frames. At the upper edges of the respective frame there are clamping screws 65 for clamping the respective frame to the ceiling.

Connecting members or ties 67 and 69 are used in erecting the fixture and are removed when the frames are clamped. A template 71 is used for marking up against a wall (the rear wall or a wall on either side) or ceiling, and gives the location of the flue gas passage. The template is made in three variations, one for rear connection, one for side connection and one for top connection of a flue gas pipe. The angle sections forming the uprights 59 and 61 face outwards from the space defined by the frames 51 and 53, to enable the insertion of blocks from the side through the frame 53, for mortaring together in the production of the tile stove.

The inventive erection device also results in the advantage that, when it is set up, it gives an idea of suitable placing etc. in relation to such as floor battens and roof trusses with associated chimney locaction. The impression of entirety, e.g. from the furnishing aspect, can also be judged, possibly with a screen loosely put on the erection frame and representing the tiled stove front, such as it will approximately appear in a finished condition. The frame pairs 51, 53 are further marked off with the heights of the tiled stove blocks, module heights, and levels for the base 15, stove 17 and return chamber section 19. The frame pairs 51, 53 are also marked at the top edge with the position for the template 71 for measuring off and marking out the location of the flue gas pipe passage.

We claim:

1. For a heating apparatus of the tiled stove-type having a return chamber section, a stove section providing a hearth, and a foot section, said stove section being formed by placing individual building blocks in a plurality of alternate horizontal courses arranged such that the vertical joints between blocks in one course are staggered with relation to the vertical joints between blocks in adjoining courses, the improvement comprising:

blocks for erecting said sections of said heating apparatus including:

blocks for said stove section having cut-out portions to provide a central up flue gas passage extending from the hearth, two vertical down flue gas passages situated outside the central passage and two further vertical up flue gas passages also situated outside the central passage, the two down flue gas passages and the two further up flue gas passages being interconnected at their lower ends in a hearth plane, a return block for said return chamber section having cut-out portions providing a return chamber interconnecting the upper ends of the central up flue gas passage and the two down flue gas passages for returning flue gasses to said stove section, said blocks for said stove section including a plurality of rear blocks for forming the upper part of the stove section, said plurality of rear blocks being successively horizontally thickened to provide a portion of the central flue gas passage inclined forwardly course to course in an upward direction for deflecting the central flue gas path towards the front part of said stove section and into said return chamber, and blocks for said return chamber section having cut-out portions to interconnect the two up flue gas passages in said return chamber section for leading flue gasses out to a chimney stack.

2. The improvement as claimed in claim 1 further including hearth-defining blocks for a horizontal course at a lower portion of said stove section immediately above said foot section including two opposing and like blocks which at their rear end portions are formed with recesses forming dovetails in which a third block with bevelled sides is accommodated for locking and sealing, said two hearth-defining opposing blocks having greater vertical height than said third block and having cut-out portions to form up and down interconnected flue gas passages.

3. The improvement as claimed in claim 2 further including blocks for forming a horizontal course immediately above said hearth including two blocks joining along a vertical plane, two of said hearth-defining blocks for opposite sides of said stove section each having a horizontally extending soot hole.

4. The improvement as claimed in claim 1 further including return blocks for forming an upper course of blocks in said return chamber section, said return blocks having cut-out portions providing a return chamber, and said upper course blocks to be situated nearest the ceiling being made from a heat insulating material, comprising Leca and a refractory binder.

5. The improvement as claimed in claim 1 further including tiles to be applied to the outside of the blocks, only the middle section of each tile providing a space to be filled and fixed to the outside of the blocks while the outer edge portions of each tile define a space between the outside of the blocks and the inside of the tiles to form air stream ducts.

* * * * *